United States Patent [19]

Platt

[11] Patent Number: 4,619,299

[45] Date of Patent: Oct. 28, 1986

[54] LOG-PEELING LATHE

[75] Inventor: Sterling B. Platt, Stamford, Conn.

[73] Assignee: Champion International Corporation, Stamford, Conn.

[21] Appl. No.: 747,916

[22] Filed: Jun. 24, 1985

[51] Int. Cl.[4] ..... B27C 7/04

[52] U.S. Cl. ..... 144/357; 82/40 R; 142/53; 144/209 R

[58] Field of Search ..... 144/213, 357, 209 R; 82/40 R; 142/48, 53, 55, 57

[56] References Cited

U.S. PATENT DOCUMENTS 4,342,348 8/1982 Lichtenwalter ..... 144/209 R 4,469,155 9/1984 Platt ..... 144/209 R

*Primary Examiner*—W. D. Bray

*Attorney, Agent, or Firm*—Evelyn M. Sommer; William W. Jones

[57] ABSTRACT

A lathe for peeling logs to produce veneer for making plywood or the like. The lathe includes sets of inner and outer dogs supporting each end of a log being peeled. A reciprocating-pressure bar or roller is included for engaging the peeled veneer adjacent to the knives. The lathe is operated by a programmed controller. The radius of each log being peeled is determined by the controller based on the position of the pressure bar or roller after round up of the log. When the radius of the log is greater than a preprogrammed value, the log core is released from the lathe after peeling to the diameter of the outer dogs. When the radius of the log is less than the preprogrammed value, the log core is released from the lathe after peeling to the diameter of the inner dogs. The controller automatically determines to which core diamter each log is to be peeled.

13 Claims, 7 Drawing Figures

LOG-PEELING LATHE

This invention relates to an improved apparatus and method for peeling logs to produce veneer for making paneling and the like. The apparatus of this invention is an automated, or semiautomated lathe which utilizes log end supporting dogs of the type disclosed in my U.S. Pat. No. 4,469,155, issued Sept. 4, 1984, and in my copending application Ser. No. 727,385 filed Apr. 25, 1985.

Using the dog sets of my above-referenced patent and application, it is feasable to peel small logs, i.e., logs of twelve or less inches diameter, to produce veneer. It is also possible to peel larger logs in the lathe which utilizes these dog sets. Thus, a lathe equipped with these dog sets can be used to peel logs having diameters in the range of about sixteen inches down to about eight inches.

When producing veneer from logs, the newer wood on the log will produce a higher grade of veneer with a lower tendency to split than the veneer produced by the older wood in the log. This means that on all of the logs, the wood toward the outside of the log produces the highest quality veneer. With the smaller logs being the result of younger trees, good veneer will be produced by peeling the log down to a smaller diameter core. The larger logs, however, represent older trees so that the older wood in the center of the log should be left unpeeled in the form of a larger diameter core.

With the dog sets disclosed in my patent and application referenced above, an outer dog having a diameter of about four and five-sixteenths inches can be used along with an inner dog having a diameter of about two and five-eighths inches. Using such dog sets, larger logs can be peeled to a four and five-eighths inch diameter core, and smaller logs can be peeled to a two and three-quarters inches diameter core in the same lathe without having to change the dogs. I prefer to use a twelve inch diameter standard for distinguishing small logs from large logs, so that logs with a diameter of twelve inches or less, after round up, will be peeled to a core diameter of two and three-quarters inches, and logs with a diameter of more than twelve inches after round up will be peeled to a four and five-eighths inch diameter core. The small diameter cores are sold unprocessed for use as fence posts, grape vine supports, and the like. The large diameter cores are sufficient to be processed into two 2×4 studs each. After the logs are debarked, they may be rounded up (made round) in a round up machine or else in the peeling lathe itself. If rounded up in the peeling lathe, the lathe will be provided with a sensor such as a plurality of lasers, to determine when each log is rounded and uninterrupted peeling has begun.

The peeling lathes are at least semi-automatically run by a programmable logic controller (PLC) such as the PLC-3 programmable controller sold by Allen-Bradley Systems Division-PC Business, Cleveland, Ohio. The lathe will include a retractable pressure nose bar or a power roller which reciprocates toward and away from the log in the lathe. The PLC controls movement of the nose bar or power roller. When the log is fed into the lathe, if pre-rounded up, the nose bar or power roller will be moved toward the log to engage its outer surface. Once the outer surface is engaged by the nose bar or power roller, the PLC can determine what the radius of the particular log is in the lathe. Once the radius is known, the PLC will select the diameter of the core to which the log is to be peeled, the PLC having been preprogrammed to select the larger diameter core if a log diameter of over twelve inches is detected and to select the smaller diameter core if a log diameter of twelve inches or less is detected. If the log is rounded up in the lathe, then the PLC keeps the nose bar away from the exterior of the log until the sensors tell the PLC that veneer is coming out and the log is round. Once the PLC knows the log is round, the nose bar is moved against the exterior of the log and selection of the core diameter is made. Lathes having a second power roll in place of the nose bar are preferably used to peel prerounded logs only.

It is, therefore, an object of this invention to provide a method and apparatus for peeling different diameter logs to different diameter cores automatically.

It is a further object of this invention to provide a method and apparatus of the character described which determines the initial radius of a rounded up log in the apparatus and decides on a core diameter based on the initial radius of the log.

It is an additional object of this invention to provide a method and apparatus of the character described which peels twelve inch and under diameter logs to two and three-quarter inch diameter cores, and which peels logs having a larger than twelve inch diameter to four and five-eighths inch diameter cores.

It is another object of this invention to provide a method and apparatus of the character described which includes a sensor to detect roundness of a log so that the logs can be rounded up in the same apparatus used for peeling the logs immediately prior to peeling.

These and other objects and advantages of the invention will become more readily apparent from the following detailed description of a preferred embodiment of an apparatus and method operating in accordance with the invention, when taken in conjunction with the accompanying drawings, in which.

Figure 1:
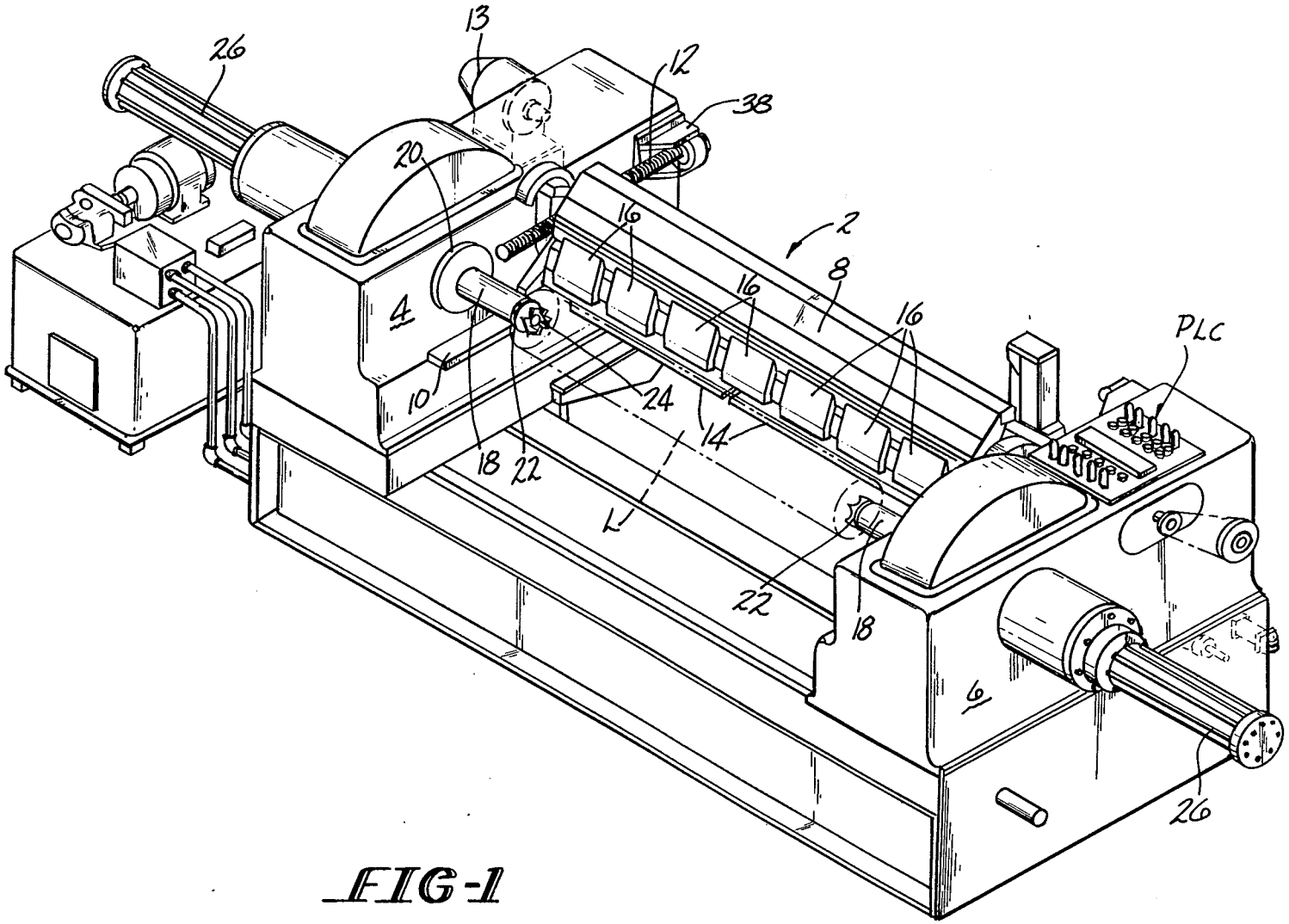
FIG. 1 is a perspective view of a log peeling lathe adapted to operate in accordance with this invention.

Referring now to the drawings, FIG. 1 shows a lathe operable to perform in accordance with this invention. The lathe, denoted generally by the numeral 2, includes a pair of end portions 4 and 6 between which the log L (shown in phantom) to be peeled is positioned. A carriage 8 extends between the end portions 4 and 6. The carriage 8 is reciprocally movable on a pair of tracks 10 (only one of which is shown). Movement of the carriage 8 in either direction is accomplished by a ball feed screw 12 driven by a reversible motor 13. Nose bars 16 are mounted on the carriage 8 for engagement with the exterior of the log L during peeling. The nose bars 16 are held against the exterior of the log during peeling by steadily advancing the carriage 8 toward the axis of the log L as the latter is peeled. After the log L has been peeled down to the selected size core, the carriage 8 is moved away from the axis of the log L by reverse operation of the motor 13 and feed screw 12. Operation of the motor 13 is controlled automatically by the PLC shown schematically on the end portion 6 of the lathe 2. The core is dropped out of the lathe 2 and a new log is dropped into the lathe.

A pair of knives 14 are mounted on a lower carriage which reciprocates vertically to move the knives 14 with respect to the log L. If the logs are to be rounded up in the lathe, the knives 14 will perform this operation with the nose bar carriage 8 in its retracted position. Movement of the knife carriage is also automatically controlled by the PLC. Extending from each of the end portions 4 and 6 toward each other are the log supporting spindles. The lathe 2 is equipped with two sets of concentric spindles, with the outer spindle 18 of each set being shown in FIG. 1. As explained hereinafter, there is an inner spindle in each set also. The spindles 18 are mounted for rotational movement in bearings 20 mounted on the end portions 4 and 6 of the lathe. Mounted on the ends of the outer spindle 18 are toothed dogs 22 which are embedded in and engage the ends of of the log L. Concentric with and within the confines of the outer dogs 22 are the inner dogs 24 which are mounted on the ends of the inner spindles and which are also embedded in and in engagement with the ends of the log L. Disposed on the outside of each end portion 4 and 6 of the lathe are the spindle retraction mechanisms 26 into which the inner and outer spindles are retracted.

Figure 2:
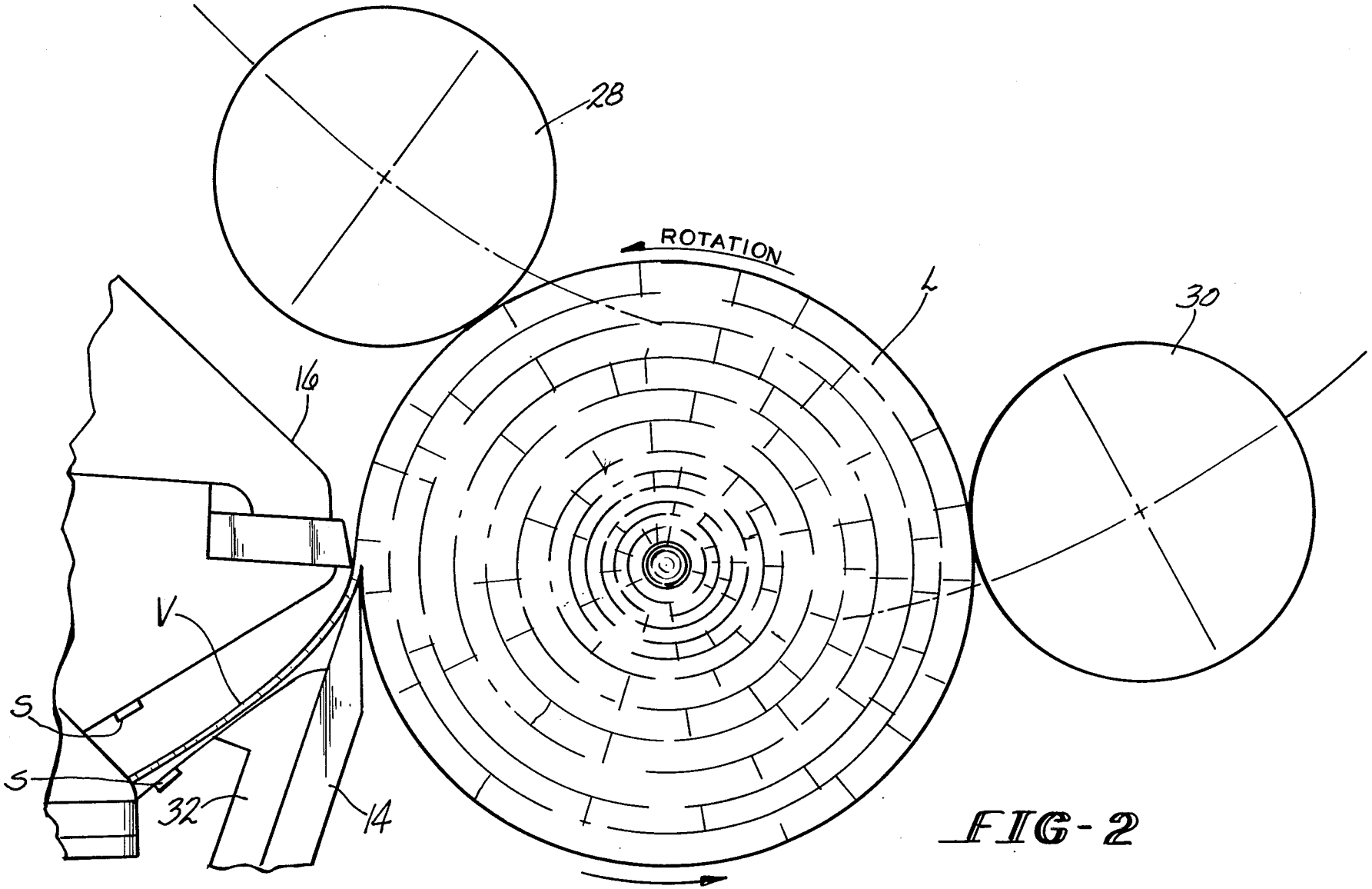
FIG. 2 is a fragemented somewhat schematic view showing the rollers, nose bar and knives in their proper orientation about the log as the latter is peeled.

Referring now to FIG. 2, there is shown schematically the manner in which the veneer V is removed while the log L is peeled. The lathe includes a power roll 28 (not shown in FIG. 1 for purposes of clarity) which is rotatably driven so as to aid in rotating the log L into the knives 14. The power roll 28 is movably mounted and is steadily advanced toward the log L to maintain contact as the log L is peeled. A guide roll 30 is also included on the lathe to steady the log L as it is rotated on the spindles and dogs shown in FIG. 1. Sensors S are mounted in the veneer chute to detect the presence of a full span of veneer V. If the log L is being rounded up in the lathe prior to peeling, the nose bar 16 will be retracted from the position shown in FIG. 2 until the sensors S detect a full span of veneer V in the chute. When this occurs, the sensors S signal the PLC that the log L has been rounded up, and the nose bar 16 is advanced by the PLC to the position shown in FIG. 2. At this point, the PLC determines the relative position of the carriage 8 on the screw drive 12. This will tell the PLC how far the nose bar 16 is from the axis of the spindles and log L and, thus, what the radius of the log L is. Once the radius of the log L is sensed, the PLC uses its preprogrammed instructions and determines whether the log L is to be peeled to a large or small diameter core.

Figure 2A:
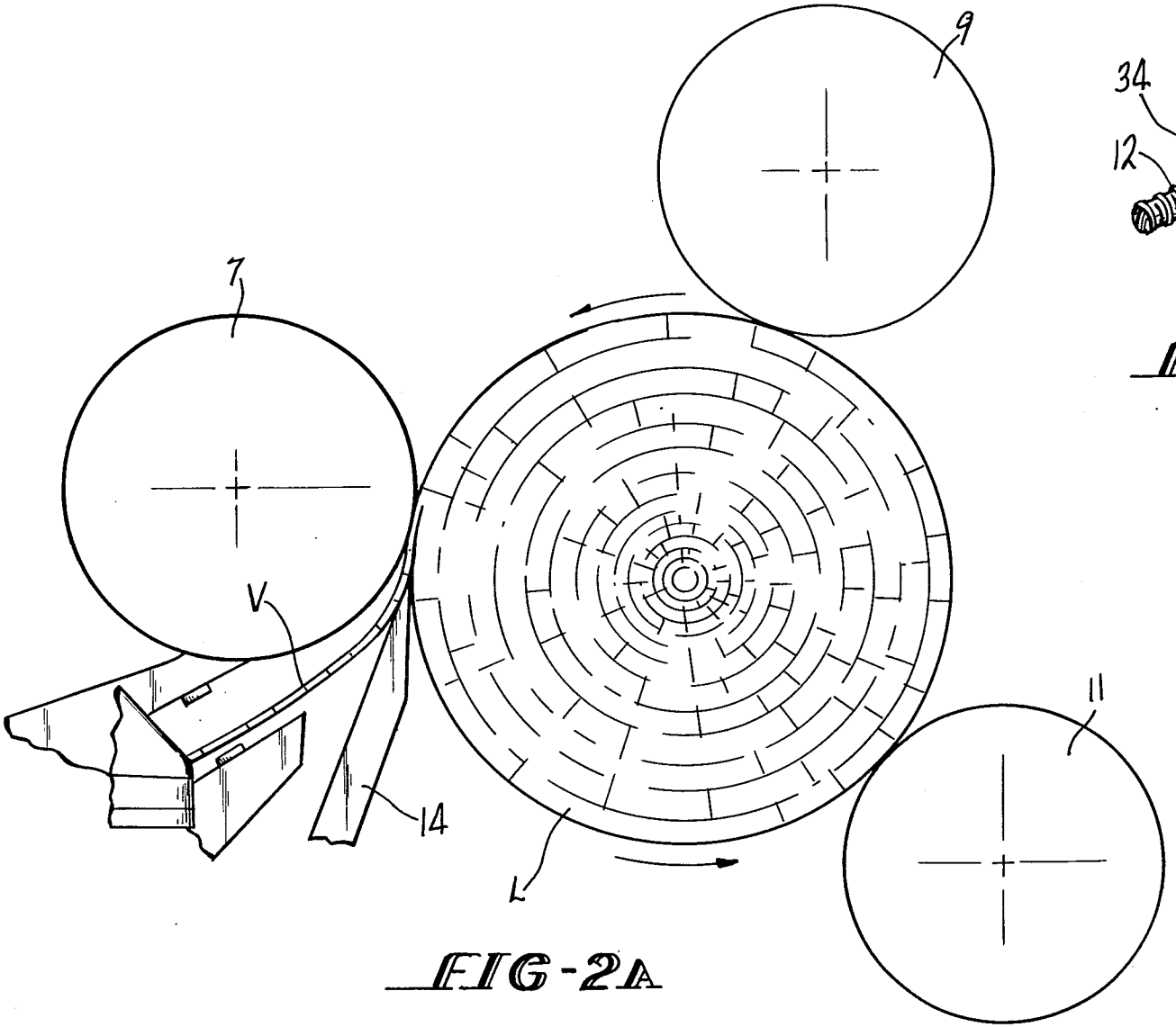
FIG. 2A is a view similar to FIG. 2 but showing a power roll replacing the nose bar.

IN FIG. 2A, a modification of the lathe is shown wherein the nose bar is replaced by a power roller 7. In this modification, the lathe has two power rollers 7 and 9 and an idler roller 11. The power roller 7 is reciprocally movable toward and away from the log L. When a log L is fed into the lathe and rounded up, the power roller 7 is moved against the exterior of the log L and when the log L is contacted, the PLC then knows the radius of the log L. As before, once the radius is known, the decision as to which size core to form is made by the PLC.

Figure 3:
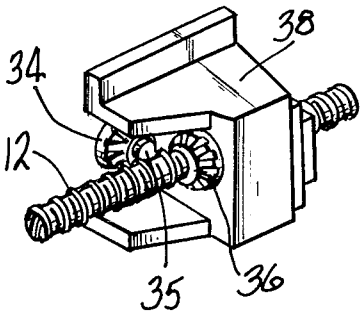
FIG. 3 is a fragmented perspective view of the feed screw portion of the lathe which is operable to reciprocate the nose bar.
Figure 4:
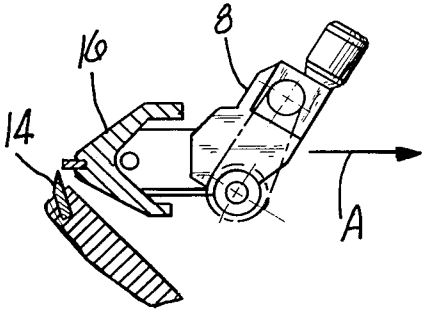
FIG. 4 is a fragmented sectioned side elevational view of the nose bar showing its mode of movement with respect to the knives.

Referring to FIG. 3, the manner in which the screw feed 12 is operated is shown. A bevel gear 34 is mounted on a shaft 35 which is selectively rotated in either direction by the reversible electric motor 13. The bevel gear 34 engages a complimentary bevel gear 36 which is keyed to the feed screw 12. The gear 36 and feed screw 12 are journaled on a bearing block 38, which is mounted on the end part 4 of the lathe 2. The shaft 35 is thus able to rotate the feed screw 12 in either direction. The carriage 8 includes pitched connections at either end thereof which connect the carriage 8 to the feed screw 12. As shown in FIG. 4, the carriage 8 is in an operative position wherein the nose bar 16 is closely adjacent to the knives 14. In this position, the nose bar 16 will engage a log mounted in the lathe during peeling of the veneer. The feed screw 12 will rotate constantly in a feeding direction so as to constantly advance the carriage 8 and nose bar 16 toward the dwindling log. The PLC controls the motor 13 so that this steady feeding of the nose bar 16 is achieved. When the log has been peeled to the preselected core diameter, the core will be released from the lathe by retracting whatever dogs are holding the ends of the log, and the PLC will reverse the rotation of the motor 13, thus causing the feed screw 12 to reverse its direction of rotation. This will cause the carriage 8 and nose bar 16 to move in the direction of the arrow A away from the axis of the dogs to allow a new log to be fed into the lathe. The carriage 8 and nose bar 16 will remain retracted until the new log has been rounded up, at which time the motor 13 will be activated by the PLC to move the nose bar 16 toward the log until the side of the log is contacted. Once contact is made, the PLC will know the radius of the log and set the spindle retractors so that the proper diameter core will be formed.

Figure 5:
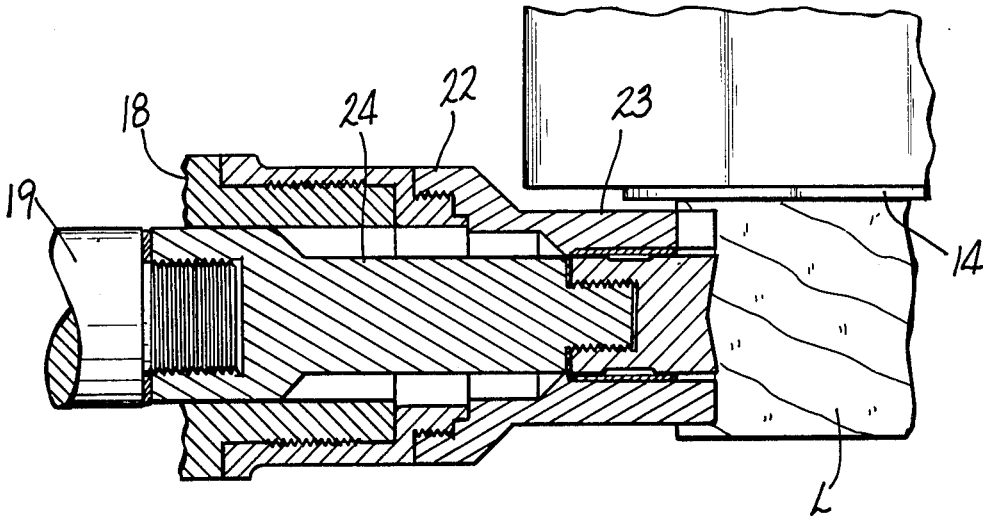
FIG. 5 is a fragmented sectional view showing the dog set holding the end of a log as the latter is peeled to a larger diameter core.
Figure 6:
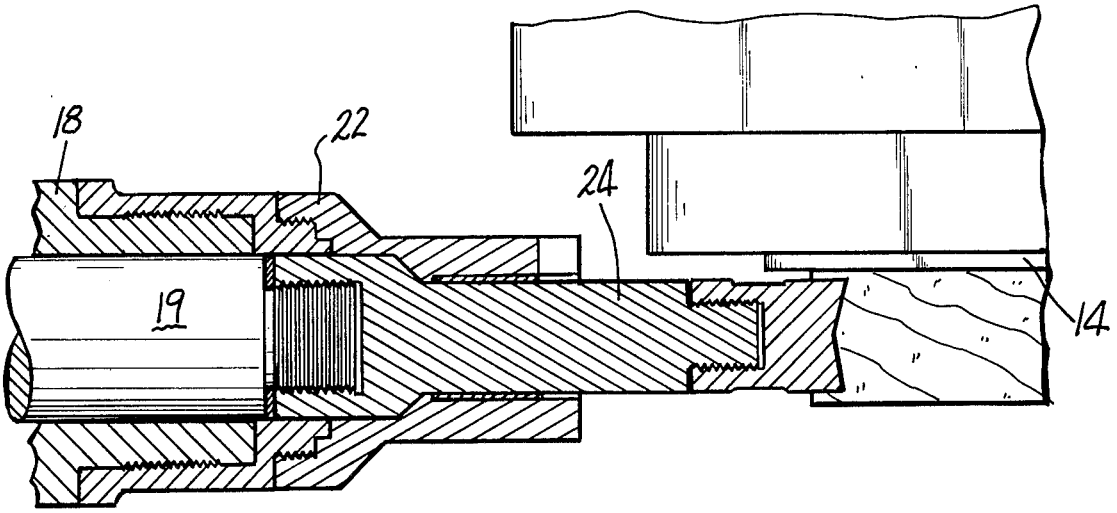
FIG. 6 is a fragmented sectional view showing the dog set with the outer dog retracted to allow the log to be peeled to a smaller diameter core.

Referring now to FIGS. 5 and 6, there is shown a preferred embodiment of the dog sets used to support the ends of the log during the peeling operation. It will be noted that the outer spindle 18 is hollow and the inner spindle 19 is journaled in the bore of the outer spindle. The outer dog 22 is mounted on the outer spindle 18 and is embedded in the end of the log L in FIG. 5. The inner dog 24 is mounted on the inner spindle 19 and is also embedded in the end of the log L in FIG. 5. The log L has been peeled to the extent that the knife 14 is practically contiguous with the outer surface of the shank 23 of the outer dog 22. At this point, if the log L began peeling as a large log, i.e., had a rounded up diameter of more than twelve inches, the PLC will actuate the spindle retractors so that both dogs 22 and 24 will be simultaneously retracted and disengaged from the log L and the resulting core will be a large core, that is to say, a four and five-eighths inch diameter core. If the log L began peeling as a rounded up small log, i.e., had a rounded up diameter of twelve inches or less, then the PLC will activate the spindle retractors to cause only the outer dog 22 to be retracted and disengaged from the log L so that peeling can continue as shown in FIG. 6. When the knife 14 reaches the point shown in FIG. 6, the PLC actuates the spindle retractors so as to pull the inner dogs 24 out of the ends of the log L thus leaving a small diameter core.

It will be readily appreciated that the method and apparatus of this invention will provide for increased production of higher quality veneer. The cores produced by the peeling of the logs will be sized in accordance with the size of the log at commencement of peeling. The apparatus can produce two different size cores without changing dogs and will automatically select which size core is most advantageous to produce. Both large and small logs can be peeled in the apparatus without any presorting, so that the logs may be fed into the apparatus randomly by size.

Since many changes and variations of the disclosed embodiment of the invention may be made without departing from the inventive concept, it is not intended to limit the invention otherwise than as required by the appended claims.

What is claimed is:

1. A log peeling lathe comprising:
(a) inner and outer spindles rotatably journalled on the lathe;
(b) an outer dog mounted on each outer spindle for embedment in ends of a log being peeled in the lathe;
(c) an inner dog mounted on each inner spindle for embedment in ends of a log being peeled in the lathe, said inner dogs nesting in said outer dogs;
(d) retraction means for selectively retracting said inner and outer dogs away from ends of a log in the lathe;
(e) measuring means for determining the round-up size of a log in the lathe; and
(f) control means for actuating said retraction means, said control means being connected to said measuring means and operable to cause concurrent retraction of said outer and inner dogs when the round up size of a log in the lathe is above a preprogrammed value, and operable to cause sequential retraction of said outer dogs first and said inner dogs last when the round up size of a log in the lathe is below said preprogrammed value whereby larger logs are automatically peeled to cores approximately equal in diameter to the diameter of said outer dogs, and smaller logs are automatically peeled to cores approximately equal in diameter to the diameter of said inner dogs.

2. The lathe of claim 1 wherein said measuring means is a member mounted for reciprocal movement on said lathe toward and away from a log disposed in the lathe.

3. The lathe of claim 1 wherein said outer dogs are approximately four and five-sixteenths inches in diameter, and said inner dogs are approximately two and five-eighths inches in diameter.

4. A log peeling lathe comprising:
(a) inner and outer spindles rotatably journalled on the lathe;
(b) inner and outer dogs mounted on said inner and outer spindles respectively for supporting ends of logs being peeled in the lathe, said inner dogs nesting in said outer dogs;
(c) retraction means for selectively retracting said inner and outer dogs away from the ends of a log in the lathe;
(d) measuring means for determining the round up size of a log in the lathe;
(e) sensing means operable to sense when a log has been rounded up in the lathe; and
(f) control means connected to said measuring means and to said sensing means, said control means being operable to actuate said measuring means to measure the size of a log in the lathe when said sensing means has sensed that the log in the lathe is rounded up.

5. The lathe of claim 4 wherein said control means is further connected to said retraction means and operable to cause the latter to selectively retract said dogs so that when a log in the lathe is determined by said measuring means to be above a preprogrammed size, then the log is peeled to a core which is approximately equal in diameter to the diameter of said outer dogs whereupon the core is released, and when a log in the lathe is determined by said measuring means to be below the preprogrammed size, then the log is peeled to a core which is approximately equal in diameter to the diameter of said inner dogs whereupon the core is released.

6. A log peeling lathe comprising:
(a) inner and outer spindles rotatably journalled on the lathe;
(b) inner and outer dogs mounted on said inner and outer spindles respectively for supporting ends of logs being peeled in the lathe, said inner dogs nesting in said outer dogs;
(c) retraction means for retracting said inner and outer dogs away from the ends of a log in the lathe; and
(d) programmable control means connected to said retraction means and operable to cause said retraction means to selectively retract said inner and outer dogs concurrently when a log is peeled to the approximate diameter of said outer dogs to produce a large diameter core, or to retract said outer dogs initially, and then retract said inner dogs when a log is peeled to the approximate diameter of said inner dogs to produce a small diameter core.

7. The lathe of claim 6 further comprising measuring means for measuring the size of rounded-up logs prior to peeling, said measuring means being connected to said control means whereby said control means operates said retraction means to produce a large diameter core when a rounded-up log measures in at above a preprogrammed level, and said control means operates said retraction means to produce a small diameter core when a rounded-up log measures in at below the preprogrammed level.

8. The lathe of claim 7, wherein said measuring means comprises a reciprocating member operated by said control means and which engages the outside of a log at commencement of peeling.

9. The lathe of claim 8 further comprising sensing means on said lathe for determining when a log is rounded-up in the lathe, said sensing means being connected to said control means whereby said control means operates said measuring means in response to said sensing means sensing a rounded-up log in the lathe.

10. The lathe of claim 7 wherein said preprogrammed level is about a twelve-inch log diameter, and said outer dog has a diameter of about four and five-sixteenths inches, and said inner dog has a diameter of about two and five-eighths inches.

11. A method for peeling logs in a lathe to produce veneer, said method comprising the steps of:
(a) providing a pair of dog sets, each of said dog sets comprising an outer dog and an inner dog nested in said outer dog, said outer dog having a larger diameter than said inner dog;
(b) engaging both said inner and outer dogs of each dog set with opposite ends of a log in the lathe;
(c) making an initial measurement of the log in the lathe when veneer peeling begins;

(d) peeling the log to a final core which is one of two diameters, a first of which is approximately equal to the diameter of said outer dogs, and the second of which is approximately equal to the diameter of said inner dogs, the log being peeled to said first diameter when the initial measurement of the log is above a predetermined size, and the log being peeled to said second diameter when the initial measurement of the log is below the predetermined size; and (e) releasing the core from the lathe.

12. The method of claim 11 wherein said first core diameter is approximately four and five-eighths inches, and said second core diameter is approximately two and three-quarters inches.

13. A method for peeling logs in a lathe to produce veneer, said method comprising the steps of:

(a) providing a pair of dog sets, each of said dog sets comprising an outer dog, and an inner dog nested in said outer dog, said outer dog having a larger diameter than said inner dog;

(b) moving both dogs in each dog set into supporting engagement in ends of logs fed serially into the lathe;

(c) peeling the logs in the lathe to form final cores; and (d) selectively moving said dogs out of supporting engagement with the ends of the logs so that a portion of the final cores are approximately equal in diameter to said outer dogs, and the remainder of the final cores are approximately equal in diameter to said inner dogs.

* * * * *